United States Patent [19]

Polsky

[11] Patent Number: 4,785,480

[45] Date of Patent: Nov. 22, 1988

[54] NO-BIND PANTS WITH SEAMLESS CROTCH

[76] Inventor: Bernice B. Polsky, 4300 Via Dolce, No. 316, Marina Del Ray, Calif. 90292

[21] Appl. No.: 34,401

[22] Filed: Apr. 3, 1987

[51] Int. Cl.[4] ..... A41D 1/06

[52] U.S. Cl. ..... 2/227; 2/401

[58] Field of Search ..... 2/227, 401, 407, 409, 2/77–83

[56] References Cited

U.S. PATENT DOCUMENTS 4,371,989 2/1983 Polsky .

4,488,317 12/1984 Polsky .

4,494,250 1/1985 Sheppard et al. ..... 2/227

*Primary Examiner*—Henry S. Jaudon

*Attorney, Agent, or Firm*—Andra M. Finkel

[57] ABSTRACT

The invention comprises a new and improved garment having pant legs which are shaped at the inseam so as to conform to the natural anatomical shape of the thigh. The front and back of the pant leg assume difference curvatures such that when they are sewn to a seamless crotch piece such as the one disclosed in U.S. Pat. No. 4,371,989, the garment will not rise up or bind on the wearer when the wearer sits, bends, walks or performs any other physical motion.

20 Claims, 3 Drawing Sheets

13
22
20
80
84
P3
74
r3
r4
P4
82

15
62
20
64
76
54
30
72
t1
t2
24
36
68
60
37
r2
r1
P2
70
P1
66

13a
22a
20a
P7
80a

FIG. 5
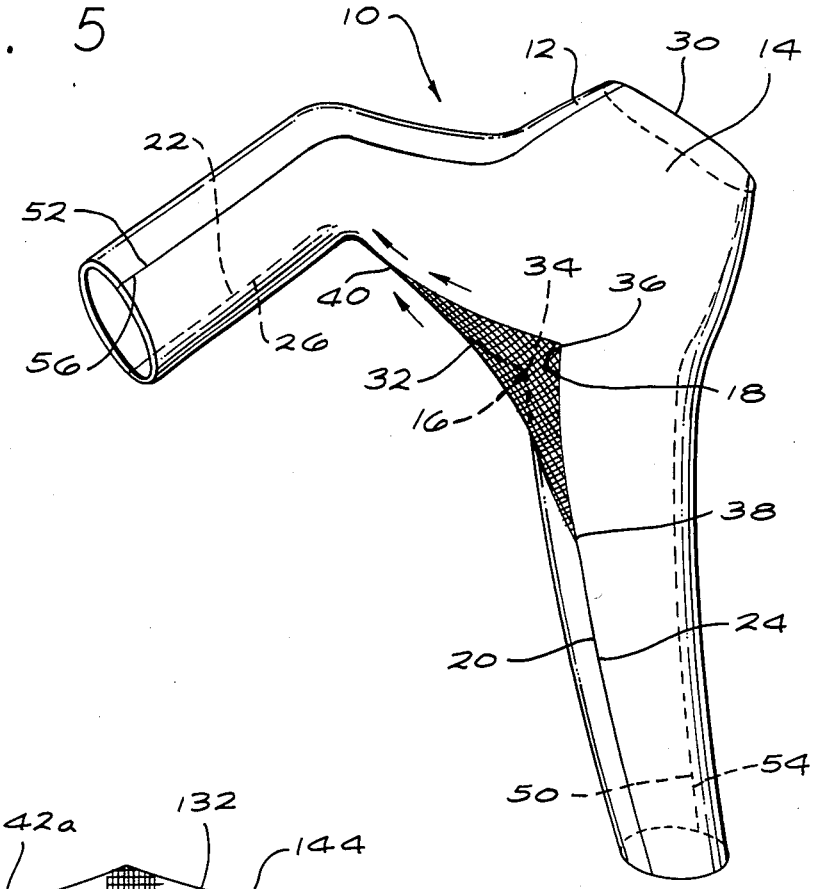
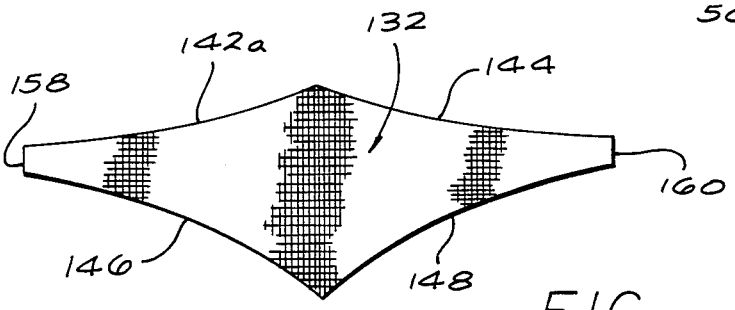
FIG. 6
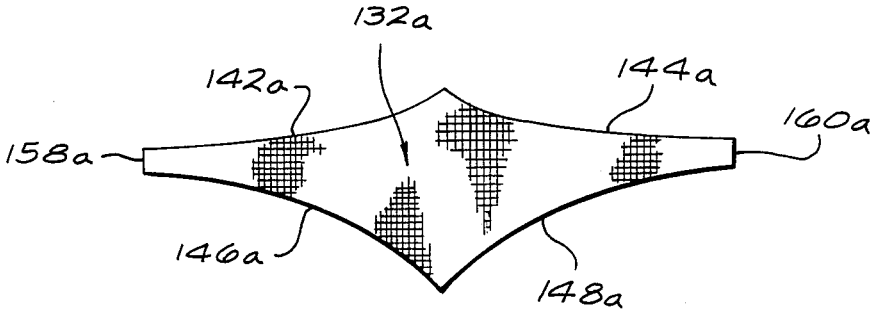
FIG. 7

NO-BIND PANTS WITH SEAMLESS CROTCH

BACKGROUND OF THE INVENTION

1. Field of the Invention

The present invention relates to the field of wearing apparel, and more particularly to pants, trousers, shorts and the like.

2. Prior Art

Aesthetics and comfort are often at odds in the design of garments having pants portions. On the one hand, it is usually desired that such a garment present a pleasing appearance while the wearer is walking, bending, squatting, or sitting, or otherwise assuming any other position that might be typically assumed in the course of a day. On the other hand, it is desired that such garments be comfortable to the wearer if sitting, squatting or in any other position that might typically be assumed. In particular, it is undesirable to some to have pants be baggy due simply to the need for a garment which is comfortable and does not restrict movement in the thigh, crotch and buttocks area.

Pants garments, constructed in the conventional manner are such that the comfort of the wearer is less than optimum, and have been known to be an outright cause of women's vaginal irritations, sometimes leading to cutaneous nerve damage, as well as some cases of infertility in men. It is found that the wearer may experience some discomfort in the thigh area while sitting or crouching, even in pants in which the crotch of the garment is normally an inch or more away from the crotch while wearer is standing. The ride-up or bind which occurs in such positions make the pants feel tight and uncomfortable to the wearer while irritating the inner thigh area.

The problem of providing conventional garments having pants portions suitable for everyday use that are both aesthetically acceptable from the point of view of being comfortable but not too baggy in the crotch area has been solved by the inventions described and claimed in U.S. Pat. Nos. 4,371,989 and 4,488,317 both issued to the present inventor. U.S. Pat. No. 4,371,989 generally concerns form-fitting garments of the type generally worn for dancing, exercise or similar activities. That invention solved the problem of crotch bind and ride-up in such garments in an aesthetically pleasing manner through the use of a crotch piece which was fabricated of material stretchable in at least one direction. U.S. Pat. No. 4,488,317 generally concerns pants-like garments having a seamless crotch construction using conventional straight line shaped pants portions which accommodate the crotch piece of U.S. Pat. No. 4,371,989. Subsequent to these inventions, however, through further thorough research, the positive conclusion was reached that the pant legs must be shaped at the upper inseam so as to conform to the natural anatomical shape of the thigh. Otherwise, the pant legs will fold when standing and pull along the thigh and seat when stressed due to any physical activity of the wearer. Thus, a garment having structural similarities to the garment described in U.S. Pat. Nos. 4,488,317 and 4,371,989 having specially anatomically designed pants portions which accommodate the crotch portion could enhance the comfort of conventional pants for all members of our society who have need for them, as well as eliminate the health risk heretofore resulting from the wearing of tight form-fitting pants which are seamed at a cross section in the upper inner thigh and crotch.

SUMMARY OF THE INVENTION

The present invention is useful for garments having pants portions of any length or style, such as jeans, slacks, shorts, johdpurs, etc.

An object of the present invention is to provide a garment suitable for men, women, children, or infants made of any material which provides more comfort to the wearer without compromising the aesthetical considerations in the area of the thigh and seat.

A garment using the present invention, therefore has four pants portions and a crotch piece; each of these pieces especially designed to follow the structure of the human anatomy in the area of the crotch, inner thigh, and seat, and each piece especially designed to accommodate the other pieces perfectly. The upper inside edge of each pant portion have concave and convex portions which conform as much as possible to the natural musculature of the inner thighs. The crotch piece has concave edges which are shorter in the front and longer in the back which conform to the upper inside edges of the pant portions to which it is attached. As used in conventional length pants, the crotch piece has a long tapering shape. In the preferred embodiment, the points of the tapered crotch piece have been cut off to facilitate the assembly in production. As a result of this construction, a garment made in accordance with the present invention is aesthetically pleasing as well as totally comfortable with no bind in the area of the inner thigh, seat and crotch.

In the prior art garments, where the inside edge of the upper leg portion of the pants are not anatomically conformed, the garment tends to ride up on the inner thigh and seat area when the wearer performs physical activity such as sitting, squatting, or bending over. When any of these positions is assumed, the back part of the garment must cover more area so that the garment naturally tends to pull downward at the back of the waist and to ride up and create a bind in the thigh and seat areas in order to compensate for the pull. In conventional garments, this effect is accentuated by four seams which connect in a cross-section in the middle of the crotch, which must absorb the entire pulling force. In the garments disclosed in U.S. Pat. Nos. 4,371,989 and 4,488,317, the pull in the crotch area is solved. In the present invention, the forces are redirected on either side of the curved seam lines attaching the crotch piece to the two anatomically conformed front pant portions and two back pant portions rather than along the center of the crotch itself.

A garment having such anatomically conformed front and back pants portions and a seamless crotch piece allows for total comfort in the inner thigh, seat and crotch areas. Since this garment may be fabricated in any type of material fabric, both woven and nonwoven, stretch or rigid fabric, the usage or type of pant garment is unlimited. Further, the pants portions having specifically shaped convex and concave curves in the area of the inner thigh to accommodate the crotch piece do not need to intrude into the main areas of the garment to any appreciable extent and therefore remain substantially unnoticed while standing or walking. Hence, any pants garments may maintain an aesthetically pleasing quality when made in accordance with the present invention.

BRIEF DESCRIPTION OF THE DRAWINGS

FIG. 5 is a perspective view of the pair of pants of FIG. 1 particularly illustrating how the thigh portion of the pant leg does not ride up or bind the wearer.

FIG. 6 is a pattern of the preferred embodiment of the crotch piece used in the pair of pants in FIG. 1.

FIG. 7 is an alternate crotch portion for a form fitting crotch.

DESCRIPTION OF THE PREFERRED EMBODIMENT

The present invention can be employed in garments having pants portions, whether such garments are intended for dress, casual, athletic, uniform or any other use. The garments may be somewhat form-fitting in the buttocks and thigh areas, such as jeans, or more conservatively tailored such as dress pants. The present invention may also be used in garments having truncated leg portions, such as shorts.

The seamless crotch construction and the integral pants portions of the present invention can be used with any material, woven or stretch fabric. The construction of pants made in accordance with the pattern pieces of the present invention significantly increases the comfort of the wearer.

Figure 1:
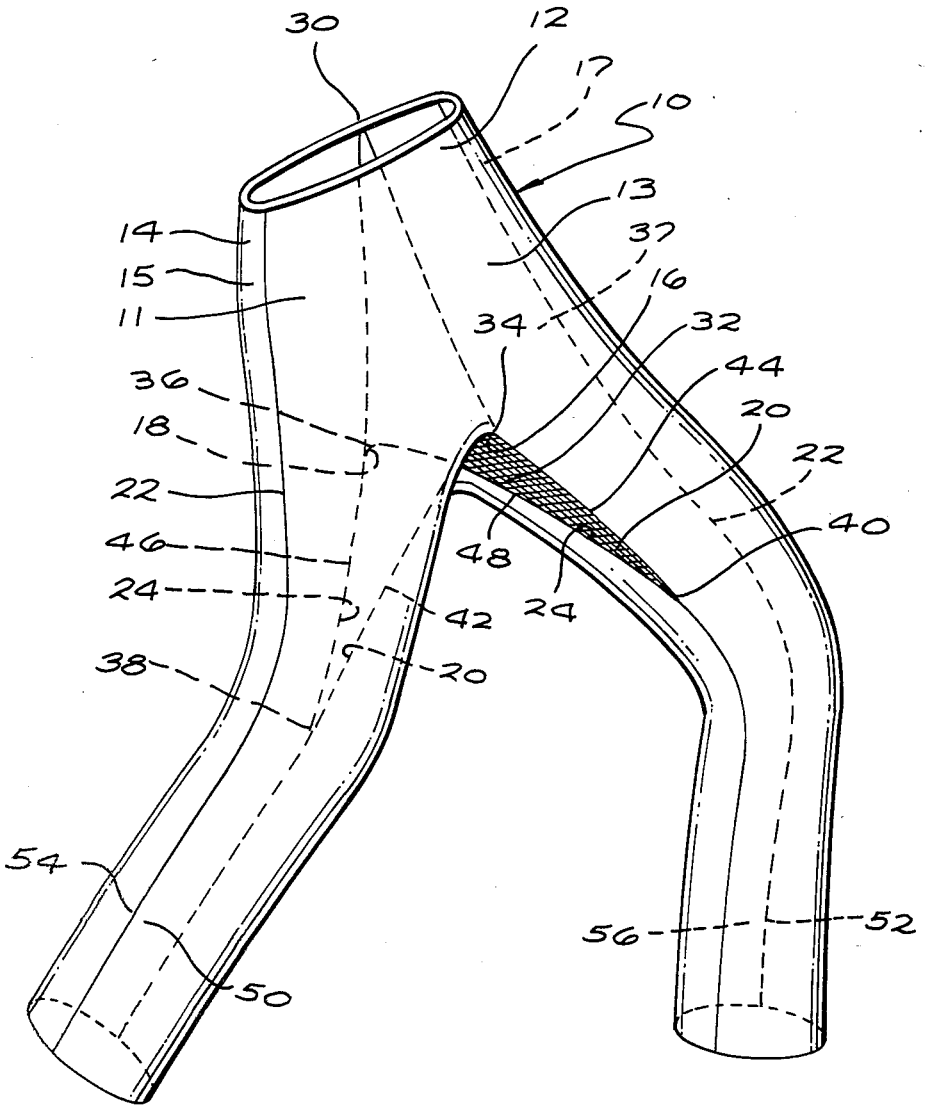
FIG. 1 is a perspective view of a pants garment made according to the present invention.

A conventional length garment, such as shown in FIG. 1 will be described as a preferred embodiment of the present invention. For purposes of the present description, the pants garment 10 shown in FIG. 1 comprises three essential pieces of fabric, the front section 12 and the rear section 14, each of which has trunk and leg areas, and a crotch piece 32. Front section 12 may be fabricated from two or more pieces of material such as a first front pants portion 11 and a second front pants portion 13, and rear section 14 may be fabricated out of two or more pieces of material such as a first back pants portion 15 and a second back pants portion 17. Each said section 12 or 14 is generally shaped in the form of an inverted V. The inside edge 20 of the front section 12 that form the inverted V are shaped so as to conform to the anatomical musculature of the thigh. The front section 12 may be provided with a fly.

Figures 2, 3, 4:
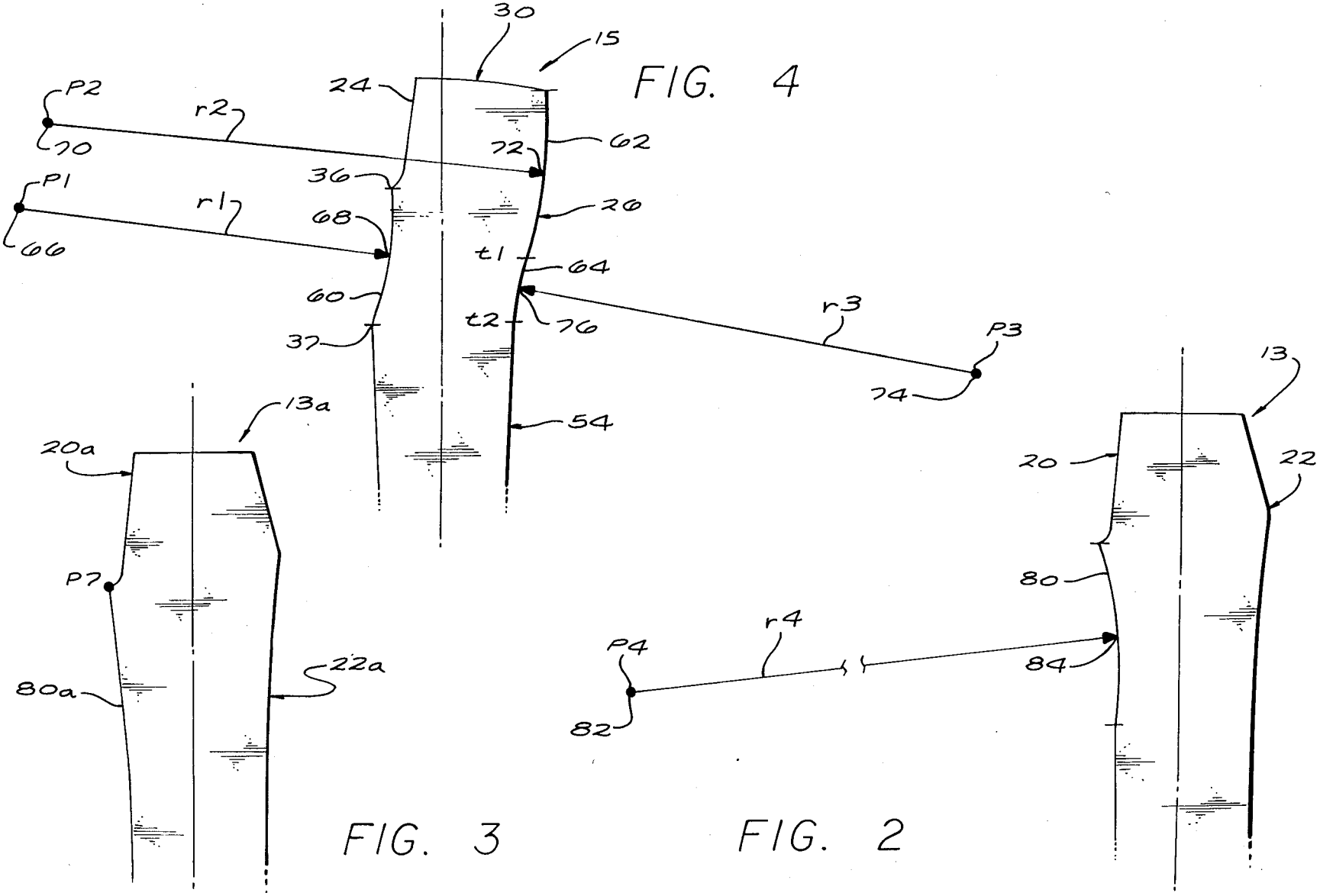
FIG. 2 is an elevational view of one embodiment of the front pants portion of FIG. 1.
FIG. 3 is an elevational view of another embodiment of the front pants portion of FIG. 1.
FIG. 4 is an elevational view of of the back pants portion of FIG. 1.

Specifically, referring to FIGS. 1, 2 and 4, the first and second front portions 11 and 13 are identical mirror images of each other. The first and second rear portions 15 and 17 are also identical mirror images of each other. It will be appreciated that the shape and relative dimensions of the pants portions complement the natural shape and structure of the body in the inner thigh, seat and crotch area.

Referring more specifically to FIG. 4, an elevational view of the back pants portion 15 is shown containing at least three curves 60, 62 and 64. Curves 62 and 64 are on the outer edge 54. Curve 60 is on inner thigh edge 24. The buttocks area curve 62 is an outward curve extending from waistband 30 to line t1. The thigh area curve 64 is an inward curve extending from line t1 to line t2. The inner thigh curve 60 is an outward curve extending from point 36 to point 37. The curve 60 is an arc of a circle centered at point p2. The radius r1 of the circle extends from point p1 to point 68. The curve 62 is an arc of a circle centered at point p2. The radius r2 of the circle extends from point p2 to point 72. The curve 64 is an arc of a circle centered at point p3. The radius r3 of the circle extends from point p3 to point 76. Point t1 is the tangent point of curves 62 and 64.

The first curved surface is on the inner thigh area and is a first arc 60 along 20° of a circle centered at point P1. The second curve is a second arc 62 on the outer thigh along 20° of a circle centered at point P2 and is tangent at point t1 with a third arcuate surface which is a third arc 64 along 8° of a circle centered at point P3. The radius of the first arc 60 is indicated by line r1 and has a beginning and end point 66 and 68 respectively. The radius of the second arc 62 is indicated by line r2 and has a beginning and end point 70 and 72 respectively. The radius of the third arc 64 is indicated by line r3 and has a beginning and end point 74 and 76 respectively.

Referring next to FIG. 2, an elevational view of a front pants portion 13 having an inner edge 20 and an outer edge 22. Inner edge 20 is shown containing a single arcuate surface on the inner thigh edge which is along 10° of a circle centered at point P4. The radius of the fourth arc 80 is indicated by line r4 and has a beginning and end point 82 and 84 respectively.

At the lower end of the thigh portion in the front and back pants portions, all of the curves become essentially vertical (straighten out).

In constructing a pair of pants using pants portions 11, 13, 15 and 17, the rear edges 46 and 48 adjacent to the rear point 18 are slightly longer than the front edges 42 and 44 adjacent to the front point 16. This difference in length compensates for the fact that the seat 37 is located closer to the waist 30 than is the crotch point 16 of the front section 12, thus making the inside edge 24 of the rear section 14 slightly longer than the inside edge 20 of the front section 12.

Referring next to FIG. 3, an elevational view of another embodiment of the front pants portion **13*a* is shown which comprises an inner edge 20*a* which is essentially straight below point P9 and an outer edge 22*a* and comprises essentially no curved surfaces. The outer edge 22*a* is identical to the outer edge 22 of the pants portion shown in FIG. 2. The inner edge 20*a* differs insofar as area 80*a*** is vertical rather than being curved. There are essentially no curved surfaces on the alternate front portion.

It will be appreciated that the shape and relative dimensions of the pants portions complement the natural shape and structure of the body in the inner thigh, seat and crotch area. Thus, the distance between the longitudinal axis of the front pants portion 13 and the front crotch point 16 is greater than the the distance between the longitudinal axis of the back pants portion 17 and the back crotch point 18. Similarly, the crotch point 18 of rear section 17 is slightly closer to the waist 30 than the crotch point 16 of the front portion 13 because the inner thigh and seat area of the human body extends more rearward than forward when considered with respect to the center line of the insides of the legs. Similarly, the upper thigh of a person generally increases in circumference in the direction toward the trunk of the body. Thus, the inner thigh area of the pants portions must appreciably widen in the area of the crotch. The edges 42, 44, 46 and 48 perform this function and result in pants portions which are well suited for meeting the requirements set by the basic dimensions and shape of the upper thigh and trunk area of the body.

Referring more specifically to FIGS. 1, 2 and 4 the crotch points 16 and 18 of the front and rear sections 12 and 14 respectively at which the leg sections separate from the trunk are located higher up, i.e., nearer to the waist 30 than they are in conventional pants-type garments. This is because the remainder of the garment which proceeds around the crotch of the wearer is comprised of a third or crotch piece 32. Crotch piece 32 is a generally curved substantially diamond-shaped piece of fabric having concave edges. The shorter points of the diamond form the front point 34 and the rear point 36 of the crotch piece and are connected respectively to the crotch point 16 on the front section 12 of the garment 10 and the crotch point 18 on the rear section 14 of the garment 10. The longer sections 38 and 40 of the crotch piece 32 extend down the insides of the legs of the garment 10 and are attached to the inside edges 80 of the front section 12, and 60 of the rear section 14. More specifically, edges 42 and 42 are attached to inside edges 80 of front sections 11 and 13, and edges 46 and 48 are attached to inside edges 60 of rear sections 15 and 17. The construction of the garment 10 is completed by stitching the corresponding outside edges 50 of the front section 12 to 54 of the rear section 14 and 52 of the front section 12 to 56 of the rear section 14.

The characteristic of a garment having the above-described construction in non riding-up the thigh of a wearer can be seen with respect to FIG. 5. In a typical garment, an action by the wearer in which one leg moves with respect to the trunk area and to the other leg tends to exert a pull on the garment in the inner thigh, crotch and buttocks area. This is true because when the leg is so moved, such as shown in FIG. 5, the effective distance between the waist and back of the knee, for example, measured along the contour of the body, increases. As the knee is raised, such as is shown in FIG. 5, there is a pull from the middle of the back of the waist around the buttocks and crotch area to the inside and back of the leg and down the leg. Thus, a movement such as is shown in FIG. 5 would tend to make a conventional garment ride-up the inner thigh and crotch. This effect, of course, is more pronounced the more form-fitting the garment is in the buttocks and thigh area.

In a garment employing the pants legs of the present invention, however, the pull exerted on the garment along the leg portions is transmitted to the crotch piece 32 along the concave edges 42, 44, 46 and 48 of the pants portions and there is no crotch ride-up. This can be understood by reference to the arrows in FIG. 5. It is believed that a pulling force exerted at a point on the seam is transmitted along a significant portion of the length of the seam so that the tapering portion of the crotch piece 32 is pulled generally in a direction along its longitudinal axis as shown by the arrows in FIG. 5. As this longitudinal axis in the area of the crotch is across the crotch, the pull on the thigh portion of the pant leg is to a large extent across the crotch rather than along the crotch as in a conventional garment. Thus a garment employing the above-described construction of the present invention does not ride-up the thigh during leg movements.

As seen particularly in FIGS. 6 and 7, which are two embodiments of the crotch piece 132, which is hexagonal. The front edges 142 and 144 do not meet the rear edges 146 and 148 respectively at points. Instead, front edge 142 and rear edge 146 meet transverse edge 158 at opposite ends of transverse edge 158 and front edge 144 and rear edge 148 meet transverse edge 160 at opposite ends of transverse edge 160. The concave edges 142, 144, 146 and 148 are shorter than the corresponding concave edges 42, 44, 46 and 48 of the crotch piece 32 in FIG. 1 because during manufacture of the garment, it is easier to see and connect the crotch piece to the pants portions at the point at which the seam lines meet without the point extension which becomes extra and unnecessary fabric after the garment has been constructed with any standard seam width. The crotch piece of FIG. 6 differs slightly from the crotch piece in FIG. 7 insofar as edges **142*a* and 144*a* are more curved than edges 142 and 144 of FIG. 7**.

It will be appreciated from the above description of presently preferred embodiments that other configurations are possible and within the scope of the present invention. For example, the preferred embodiments were described in terms of conventional garments having a pants portion. However designs in which an integral top part is fabricated with the bottom part of a garment, such as bib overalls or jump suits are also within the scope of the present invention. Thus, the present invention is not intended to be limited to the particular embodiment specifically discussed hereinabove.

What is claimed is:

1. A pants garment covering the lower trunk, buttocks, thighs and legs, comprising:

a left and a right front pants portion, which are mirror images of each other, each front pants portion comprising a front waistband edge, a convexly curved outer edge extending from the waistband edge down buttocks, outer thigh and leg segments, and a front inner edge comprising front trunk, inner thigh and inner leg segments, said front inner thigh segment shaped like a first concave arc extending between a front crotch point and the inner leg segment, said front trunk portion extending between said front crotch point and said waistband edge;

a left and a right rear pants portion, which are mirror images of each other, each rear pants portion comprising a rear waistband edge, a first convexly curved outer edge extending from the waistband edge down the buttocks, a second partially convex curved outer edge extending down the thigh between the first curved outer edge to a first substantially first straight leg edge, and an inner edge comprising rear trunk, inner thigh and leg segments, said inner thigh segment shaped like a second concave arc between a rear crotch point and the leg segment, said rear trunk segment extending between the rear crotch point and waistband edge;

a generally polygonal-shaped crotch piece having a pair of identical concave front edges which are the same length and shape as said first concave arc of said front pants portions and a pair of corresponding concave rear edges, which corrspond to said second concave arc of said rear pants portions, said front edges meeting at a first point and said rear edges meeting at a second point opposite said first point, said first point being joined to said front pants portions at said front crotch points, said second point being joined to said rear pants portions at said rear crotch points, each said front edge being joined to said front inner thigh segment of each of said front pants portions, each of said rear edges being joined to said rear inner thigh segment of each of said rear pants portions, and said front trunk segments being joined to each other, said rear trunk segments being joined to each other, said left front outer edges being joined to said right rear outer edges and said left front leg segments being joined to said right rear leg segments, said right front outer edges being joined to said left rear outer edges and said right front leg segments being joined to said left rear leg segments.

2. A garment as in claim 1 wherein said front pants portions and said rear pants portions have truncated legs and wherein said crotch piece has transverse edges joining the corresponding front and rear edges.

3. A garment as in claim 1 wherein said front pants portions, said rear pants portions and said crotch piece are each fabricated of substantially nonstretchable material.

4. A garment as in claim 1 wherein said front pants portions, said rear pants portions and said crotch piece are each fabricated of woven or knitted material.

5. The improvement of claim 1 wherein said crotch piece has transverse edges connecting said front and rear edges on each side of said garment.

6. The improvement of claim 1 in a garment having a fly wherein said point at which said front edges meet is located below said fly.

7. In a garment covering the trunk, buttocks, thighs and legs having a generally polygonal-shaped crotch piece having a pair of concave front edges and a pair of concave rear edges, one said front edge and one said rear edge located on each side of the center of said garment, said front edges meeting at a first point toward the front center of the garment below the waistline and extending from said point generally in a direction away from the front of the garment and the waistline, said rear edges meeting at a second point at the rear of the garment and extending from said point generally in a direction away from the rear of the garment and the waistline, said front and rear edges on each side of said garment approaching one another as said edges extend generally away from said waistline, the improvement comprising:

a left and a right front pants portion, which are mirror images of each other, each front pants portion comprising a front waistband edge, a convexly curved outer edge extending from the waistband edge down buttock, outer thigh and leg segments, and a front inner edge comprising front trunk, inner thigh and inner leg segments, said front inner thigh segment shaped like a first concave arc extending between a front crotch point and the inner leg segment, said front trunk segment extending between said front crotch point and waistband edge;

a left and a right rear pants portion, which are mirror images of each other, each rear pants portion comprising a rear waistband edge, a first convexly curved outer edge extending from the waistband edge down the buttocks, a second partially convex curved outer edge extending down the thigh between the first curved outer edge to a first substantially straight leg edge, and an inner edge comprising rear trunk, inner thigh and leg segments, said inner thigh segment shaped like a second concave arc between a rear crotch point and the leg segment, said rear trunk segment extending between the rear crotch point and waistband edge; the first point being jointed to said front pants portions at said front crotch points, the second point being joined to said rear pants portions at said rear crotch points, each front edge being joined to said front inner thigh segment of each of said front pants portions, each of the rear edges being joined to said rear inner thigh segment of each of said rear pants portions, and said front trunk portions being joined to each other, said rear trunk segments being joined to each other, said left front outer edges being joined to said right rear outer edges and said left front leg segments being joined to said right rear leg segments, said right front outer edges being joined to said left rear outer edges and said right front leg segments being joined to said left rear leg segments.

8. A garment as in claim 7 wherein said crotch piece has transverse edges joining the corresponding front and rear edges.

9. A garment as in claim 7 wherein said front pants portions, said rear pants portions and said crotch piece are each fabricated of substantially nonstretchable material.

10. A garment as in claim 7 wherein said front pants portions, said rear pants portions and said crotch piece are each fabricated of woven or knitted material.

11. A garment for covering the lower trunk, buttocks, thigh and legs comprising:

a front pants portion comprising a trunk area and left and right front thigh and leg areas, said trunk area having outer edges and said left and right front thigh and leg areas having inner and outer edges, said left and right front thigh and leg areas being mirror images of each other, said front pants portion having a waistband edge, said front outer edges comprising first convexly curved outer edges extending from the waistband edge down the buttocks, second partially convex outer edges extending between the first curved outer edges and the leg areas, down the thigh areas; said front inner edges comprising thigh and leg edges, said front inner thigh edges comprising a first concave arc extending between a front portion crotch point and the leg edges; said inner left and right thigh and leg areas and forming a inverted V and meeting said trunk area at a front crotch point;

a rear pants portion comprising a trunk area and left and right rear thigh and leg areas, said trunk area having outer edges and said left and right rear thigh and leg areas having inner and outer edges, said left and right rear thigh and leg areas being mirror images of each other, said rear pants portion having a waistband edge, said rear outer edges comprising convexly curved outer edges extending from the waistband edge down the buttocks, second partially convex outer edges extending between the first curved outer edges down the thigh areas; said rear inner edges comprising thigh and leg edges, said rear inner thigh edges comprising a second concave arc extending between a rear crotch point and the leg edges; said inner left and right thigh and leg areas and forming an inverted V and meeting said trunk area at a rear crotch point, said front piece and said rear piece being joined together at the outside edges of said legs and trunk area; and a generally polygonal-shaped crotch piece having a pair of identical concave front edges which are the same size and shape as said first arc of said front pants portions and a pair of corresponding concave rear edges, which correspond to said second arc of said rear pants portions, said shorter front edges meeting at a first point and said longer rear edges meeting at a second point opposite said first point, said first point being joined to said front piece at said front piece crotch points, said second point being joined to said rear pants portions at said rear piece crotch points, each said front edge being joined to said front and inner thigh segment, each said rear edge being joined to said rear inner thigh segment, and said front leg segments being joined to said rear leg segments.

12. A garment as in claim 11 wherein said front piece and rear piece have truncated legs and wherein said crotch piece has transverse edges joining the corresponding front and rear edges.

13. A garment as in claim 11 wherein said crotch piece has transverse edges joining the corresponding front and rear edges.

14. A garment as in claim 11 wherein said front piece, said rear piece and said crotch piece are each fabricated of woven or knitted material.

15. A pants garment covering the lower trunk, buttocks, thighs and legs comprising:

a left and a right front pants portion, which are mirror images of each other, each front pants portion comprising a waistband edge, a convexly curved outer edge extending from the waistband edge down the buttocks, outer thigh and leg segments and a front inner edge comprising front trunk, inner thigh and inner leg segments; said inner thigh segment being a sloped line extending between a front crotch point and the inner leg segment said trunk portion extending between the front crotch point and waistband edge;

a left and a right rear pants portion, which are mirror images of each other, each rear pants portion comprising a waistband edge, a first convexly curved outer edge extending from the waistband edge down the buttocks, a second partially convexly curved outer edge extending down the thigh between the buttocks curve to a first substantially straight leg edge, and an inner edge comprising rear trunk, inner thigh and leg segments, said inner thigh segment shaped like a first concave arc between a rear crotch point and the leg segment, said rear trunk segment extending between the rear crotch point and waistband edge;

a generally polygonal-shaped crotch piece having a pair of concave front edges which are the same size as said inner thigh segment of said front pants portions and a pair of corresponding concave rear edges, which correspond to said first arc of said rear pants portions, meeting at a second point opposite said first point, said first point being joined to said front pants portions at said front crotch points, said second point being joined to said rear pants portions at said rear crotch points, each said front edge being joined to said front inner thigh segment of each of said front pants portions, each of said rear edges being joined to said rear inner thigh segment of each of said rear pants portions, and said front trunk portions being joined to each other, said rear trunk segments being joined to each other, said left front outer edges being joined to said right rear outer edges and said left front leg segments being joined to said right rear leg segments, said right front outer edges being joined to said left rear outer edges and said right front leg segments being joined to said left rear leg segments.

16. A garment as in claim 15 wherein said front pants portions and said rear pants portions have truncated legs and wherein said crotch piece has transverse edges joining the corresponding front and rear edges.

17. The improvement of claim 15 wherein said crotch piece has transverse edges connecting said front and rear edges on each side of said garment.

18. In a garment having a generally polygonal-shaped crotch piece having a pair of concave front edges and a pair of concave rear edges, one said front edge and one said rear edge located on each side of the center of said garment, said front edges meeting at a first point toward the front center of the garment below the waistline and extending from said point generally in a direction away from the front of the garment and the waistline, said rear edges meeting at a second point at the rear of the garment and extending from said point generally in a direction away from the rear of the garment and the waistline, said front and rear edges on each side of said garment approaching one another as said edges extend generally away from said waistline, the improvement comprising:

a left and a right front pants portion, which are mirror images of each other, each front pants portion comprising a front waistband edge, a convexly curved outer edge extending from the waistband edge down the buttocks, outer thigh and leg segments, and a front inner edge comprising front trunk, inner thigh and inner leg segments, said inner thigh segment being a sloped line extending between the front crotch point and the leg segment, said front trunk segment extending between the front crotch point and front waistband edge;

a left and a right rear pants portion, which are mirror images of each other, each rear pants portion comprising a rear waistband edge, a first convexly curved outer edge extending from the rear waistband edge down the buttocks, a second partially convexly curved segment extending down the outer thigh and substantially straight leg segments and a rear inner edge comprising rear trunk, inner thigh and leg segments, said inner thigh segment being a sloped line extending between the rear crotch point and the leg segment between a rear crotch point and the leg portion, said rear trunk segment extending between the rear crotch point and rear waistband edge; said first point being joined to said front pants portions at said front crotch points, said second point being joined to said rear pants portions at said rear crotch points, each said front edge being joined to said front inner thigh segment of each of said front pants portions, each of said rear edges being joined to said rear inner thigh segment of each of said rear pants portions, and said front trunk portions being joined to each other, said rear trunk segments being joined to each other, said left front outer edges being joined to said right rear outer edges and said left front leg segments being joined to said right rear leg segments, said right front outer edges being joined to said left rear outer edges and said front front leg segments being joined to said left rear leg segments.

19. A garment as in claim 18 wherein said crotch piece has transverse edges joining the corresponding front and rear edges.

20. A garment having front and back pants portions, covering the lower trunk, buttocks, thighs and legs said garment comprising:

a front pants portion comprising a trunk area and left and right front thigh and leg, areas, said trunk area having outer edges and said left and right front thigh and leg areas having inner and outer edges, said left and right front thigh and leg areas being mirror images of each other, said front pants portion having a waistband edge, said front outer edges comprising first convexly curved outer edges extending from the waistband edge down the buttocks, second partially convex outer edges extending between the first curved outer edges and the leg areas, down the thigh areas; said front inner edges comprising thigh and leg edges, said inner thigh segment being a sloped line extending between a front crotch point and the inner leg area, and forming an inverted V and meeting said trunk area at a front crotch point;

a rear pants portion comprising a trunk area and left and right rear thigh and leg, areas, said trunk area having outer edges and said left and right rear thigh and leg areas having inner and outer edges, said left and right rear thigh and leg areas being mirror images of each other, said rear pants portion having a waistband edge, said rear outer edges comprising convexly curved outer edges extending from the waistband edge down the buttocks, second partially convex outer edges extending between the first curved outer edges down the thigh areas; said rear inner edges comprising thigh and leg edges, said rear inner thigh edges comprising a first concave arc extending between a rear crotch point and the leg edges; said inner left and right thigh and leg areas and forming an inverted V and meeting said trunk area at a rear piece crotch point, said front piece and said rear piece being joined together at the outside edges of said legs and trunk area; and a generally polygonal-shaped crotch piece having a pair of identical concave front edges and a pair of corresponding concave rear edges, which are the same size and opposite shape as said arc of said rear pants portions, said shorter front edges meeting at a first point and said longer rear edges meeting at a second point opposite said first point, said first point being joined to said front piece at said front piece crotch points, said second point being joined to said rear piece at said rear pants portions at said rear piece crotch points, each said front edge being joined to said front and inner thigh segment, each said rear edge being joined to said rear inner thigh segment and said front leg segments being joined to said rear leg segments.

* * * * *